US005338226A

United States Patent [19]

Bryce et al.

[11] Patent Number: 5,338,226

[45] Date of Patent: Aug. 16, 1994

[54] PANEL MOUNTING SYSTEM FOR ELECTRICAL CONNECTORS

[75] Inventors: James R. Bryce, Fairport, N.Y.; Rodger W. Burke, Lisle; Paul A. Reisdorf, LaGrange, both of Ill.

[73] Assignee: Molex Incorporated, Lisle, Ill.

[21] Appl. No.: 62,519

[22] Filed: May 14, 1993

[51] Int. Cl.[5] ..... H01R 13/73

[52] U.S. Cl. ..... 439/571; 439/546; 248/222.3

[58] Field of Search ..... 439/547, 567, 571, 546, 439/548, 549; 348/222.3, 222.1

[56] References Cited

U.S. PATENT DOCUMENTS

| | | | |
|---|---|---|---|
| 3,179,367 | 4/1965 | Rapata | 248/222.3 |
| 3,180,606 | 4/1965 | Sabin et al. | 248/222.3 |
| 3,403,370 | 9/1968 | Carpenter | 439/547 |
| 3,447,016 | 5/1969 | Rycroft | 439/547 |
| 3,523,267 | 8/1970 | Pauza | 439/547 |
| 3,559,152 | 1/1971 | Pearce, Jr. | 439/548 |
| 4,427,255 | 1/1984 | Cox | 439/548 |
| 5,125,846 | 6/1992 | Sampson et al. | 439/77 |
| 5,167,465 | 12/1992 | Inui et al. | 248/222.3 |

*Primary Examiner*—Gary F. Paumen
*Attorney, Agent, or Firm*—A. A. Tirva

[57] ABSTRACT

A system is provided for mounting an electrical connector to one side of a panel or other planar substrate. The connector includes a housing having a mounting face with a mounting boss projecting therefrom. The boss includes an enlarged head portion. The panel includes an aperture shaped for receiving the enlarged head portion therethrough such that the boss is rotatable in the aperture from a first insertion position and a second mounted position of the housing whereat the enlarged head portion overlaps the opposite side of the panel. Resilient detent latches on the housing snap into detent recesses in the panel automatically when the housing is in its second mounted position to lock the housing thereat.

3 Claims, 2 Drawing Sheets

PANEL MOUNTING SYSTEM FOR ELECTRICAL CONNECTORS

FIELD OF THE INVENTION

This invention generally relates to the art of electrical connectors and, particularly, to a system for mounting an electrical connector to one side of a panel or other planar substrate.

BACKGROUND OF THE INVENTION

Panel mounted electrical connectors are well known in the art, and such a connector generally includes a housing mounting a plurality of terminals for mating with a complementary connector. The housing may be mounted to a generally rigid panel for mating of the connector with the complementary connector through an opening in the panel, or the housing may be mounted on the panel simply for structural or support purposes within a circuit interconnection system.

Various means are used to mount the connector to a panel. The most prominent mounting means usually includes mounting clips or brackets operatively associated between the connector housing and the panel to mount and hold the connector to the panel. A problem with such separate mounting components is that they add to the cost of such panel mounting systems, in both the manufacturing and assembling of the systems. Other panel mounting systems have included simple mounting pegs or board locks which project from the connector housing through holes in the panel or planar substrate. A problem with simple mounting pegs or board locks is that they are not sufficiently sturdy to withstand substantial mating forces on the mounted connector.

There is a definite need for a new and improved approach to mounting electrical connectors to panels or other planar substrates, particularly a system which is inexpensive to manufacture, simple to use and reliable and sturdy in operation. This invention is directed to satisfying that need and solving the problems identified above.

SUMMARY OF THE INVENTION

An object, therefore, of the invention is to provide a new and improved system for mounting an electrical connector to one side of a panel or other planar substrate.

In the exemplary embodiment of the invention, the system includes an electrical connector having a housing, particularly a housing which is at least in part molded of plastic material. Complementary interengaging rotary mounting means are provided for mounting the housing on one side of the panel in response to rotation of the housing relative to the panel from a first position to a second position. Complementary interengaging detent latch means are provided for automatically holding the housing in the second position in response to rotation of the housing thereto from the first position.

More specifically, as disclosed herein, the complementary interengaging rotary mounting means include a boss projecting from the connector housing. The boss includes an enlarged head portion adapted to be inserted through an aperture in the panel when the housing is in its first position. The aperture is shaped relative to the enlarged head portion such that the head portion is in a mounting position against the opposite side of the panel when the housing is rotated to its second position.

Still further, the complementary interengaging detent latch means include at least one detent recess in the panel and a resilient detent latch on the housing. The resilient latch snaps into the recess automatically when the housing rotatably moves from its first position to its second position.

With the housing molded of plastic material, the mounting boss and its enlarged head portion, as well as the resilient detent latch can be inexpensively and efficiently molded integrally with the housing. These components simply cooperate functionally with a complementary aperture and recess inexpensively formed in the panel. The housing can be mounted to the panel with a simple one-handed manual manipulation by an operator, without the use of any extraneous components such as mounting clips or brackets. Once fully mounted, the combination of the mounting boss and the detent latch provide an extremely sturdy mounting system for the connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
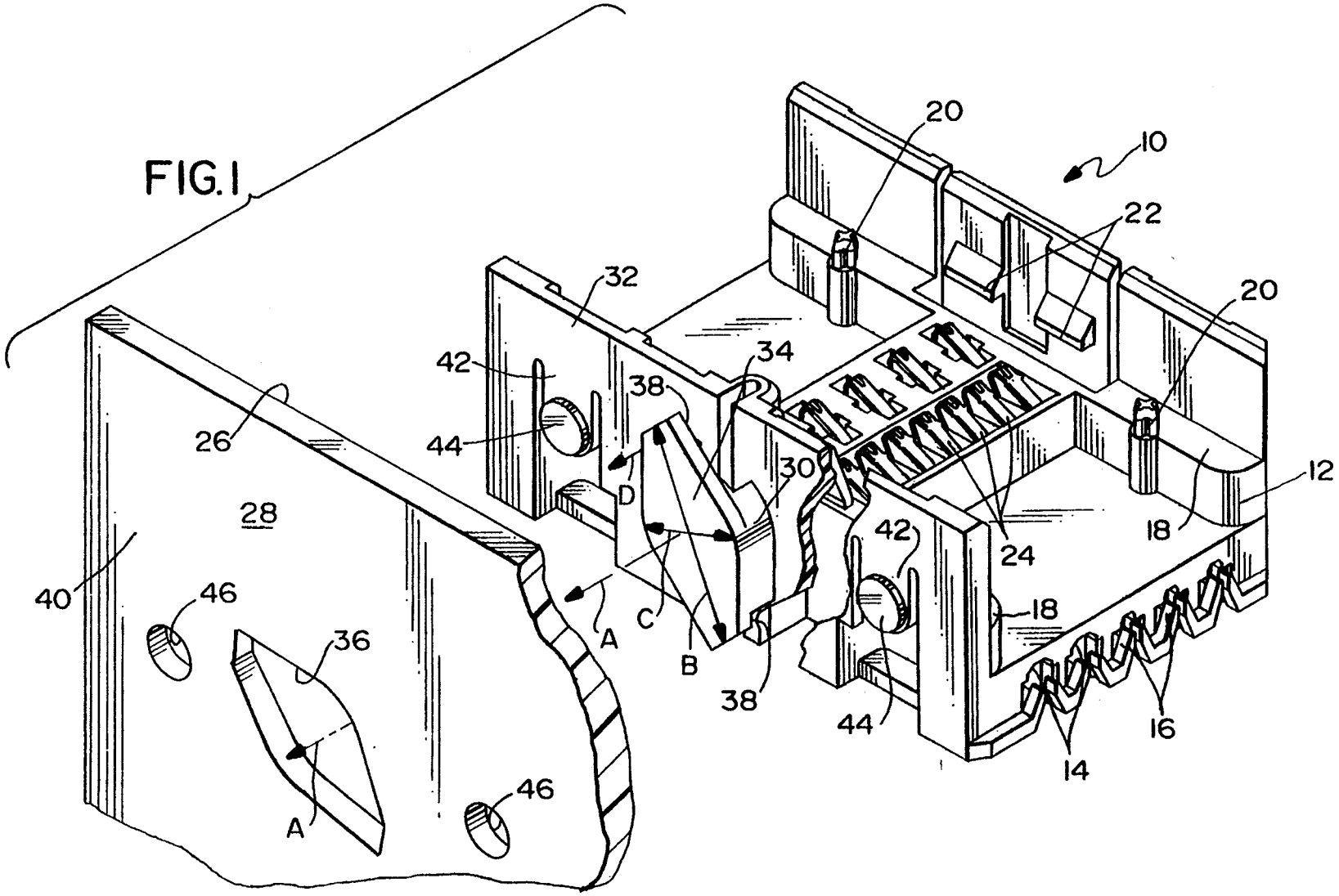
FIG. 1 is an exploded perspective view of an electrical connector and a panel, incorporating the panel mounting system of the invention.

Referring to the drawings in greater detail, and first to FIG. 1, an electrical connector assembly, generally designated 10, is shown to include a housing, generally designated 12. Connector assembly 10 is of a type shown in U.S. Pat. No. 5,125,846 to Sampson et al, dated Jun. 30, 1992, which is assigned to the assignee of the present invention and which is incorporated herein by reference. The electrical connector assembly is an input-output connector for coupling a plurality of conductors with an electronic component. As illustrated in FIG. 1, the connector is designed to connect a plurality of discrete insulated conductor wires to a printed circuit board having circuit traces thereon.

More particularly, suffice it to say that housing 12 is integrally molded of dielectric material, such as plastic or the like, and includes locating means in the form of a plurality of channels 14 for locating discrete insulated conductor wires. The channels are partially closed by retention fingers 16 whereby the conductors or wires are retained in the channels by snapping the conductors past the retention fingers. The housing has ledges 18 onto which a printed circuit board is mounted or seated, with locating pegs 20 projecting through mounting holes in the board. The circuit board is retained on ledges 18 by hooked snap latches 22. A plurality of terminals 24 interconnect the discrete insulated conductor wires with the printed circuit board. The terminals include insulation-displacement sections (not shown) for termination to the insulated conductor wires, and the terminals are surface engageable with circuit traces on the underside of the printed circuit board by the sections of the terminals shown in FIG. 1. Other details of the connector assembly are not relevant to the invention herein, but any further details can be derived from the aforementioned U.S. Pat. No. 5,125,846.

Generally, the invention contemplates the provision of complementary interengaging rotary mounting means for mounting connector housing 12 on one side 26 of a panel 28 or other planar mounting substrate. The mounting means is responsive to rotation of the housing relative to the panel. More particularly, a boss 30 is molded integrally with and projects outwardly from a side wall 32 of housing 12. The boss includes an enlarged head portion 34 which is adapted to be inserted through an aperture 36 in panel 28. Enlarged head portion 34 and aperture 36 are substantially identically shaped, with the aperture being slightly larger than the headed portion, so that the headed portion and boss 30 can be inserted into the aperture in the direction of arrows "A". The enlarged head portion and the aperture are irregularly shaped, sort of in a diamond configuration, so that the head portion has a long dimension as indicated by double-headed arrow "B", and a short dimension as indicated by double-headed arrow "C". Boss 30 has a transverse dimension generally equal to the small dimension "C" but smaller than the large dimension "B". Therefore, enlarged head portion 34 defines ledges 38 on the back side thereof which project outwardly of the boss. By rotating housing 12 slightly in the direction of arrow "D" in FIG. 1, enlarged head portion 34 will be dimensionally aligned with aperture 36 in panel 28, and the head portion can be inserted through the aperture in the direction of arrows "A". This can be considered the first or initial position of relative rotation between the housing and the panel.

Figure 2:
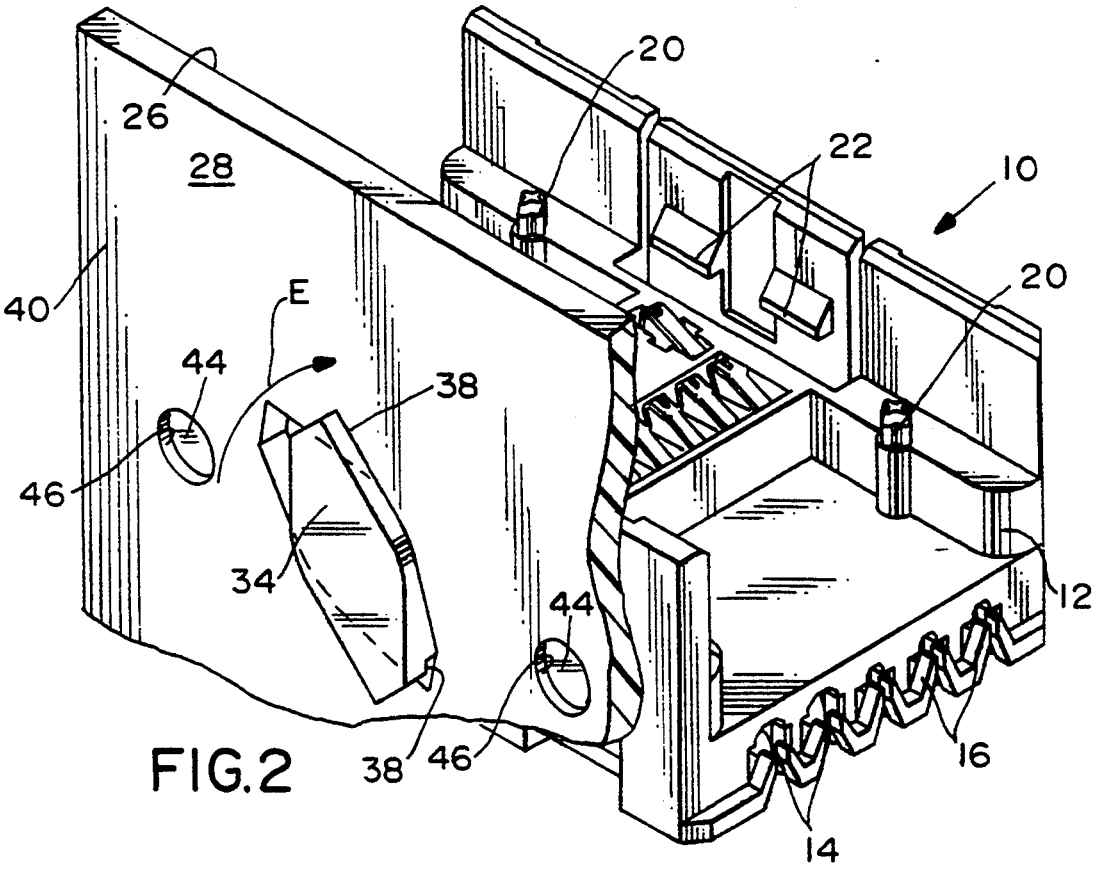
FIG. 2 is a perspective view of the connector fully mounted to the panel.

Now, referring to FIG. 2, to fully mount the connector housing to the panel, the housing is rotated relative to the panel in the direction of arrow "E". This relative rotation causes ledges 38 of enlarged head portion 34 to rotate "behind" or in juxtaposition with the opposite side 40 of panel 28. This second or final position of rotation of housing 12 relative to panel 28 is shown clearly in FIG. 2.

The invention also contemplates the provision of complementary interengaging detent latch means for automatically holding or locking housing 12 in its second or final mounting position shown in FIG. 2, in response to rotation of the housing thereto from its initial or insertion position.

More particularly, referring back to FIG. 1, a pair of cantilevered spring beams 42 are molded integrally with connector housing 12 and include detent latch projections 44 projecting outwardly from side wall 32, i.e. projecting toward panel 28. In essence, the cantilevered spring beams and latch projections provide resilient detent latches of the complementary interengaging detent latch means. Panel 28 is provided with a pair of detent recesses in the form of holes 46 which are slightly larger than detent projections 44. Both projections 44 and holes 46 are circular in shape as shown in the preferred embodiment in the drawings. In operation, detent recesses 46 are located so that resilient detent latch projections 44 snap into the recesses when connector housing is rotated to its final mounting position. This is shown in FIG. 2. In essence, the complementary interengaging detent latch means oppose rotational forces which may be applied to connector housing 12, such as during termination to its discrete conductor wires or mating with any other complementary mating electrical component.

The invention also contemplates a feature wherein the connector housing is drawn tightly against side 26 of panel 28 in response to rotation of the housing to its final mounting position. Generally, wedge means are provided on the underside of enlarged head portion 34 for drawing the housing against side 26 of panel 28 in response to rotation of the housing to its final mounting position.

Figure 6:
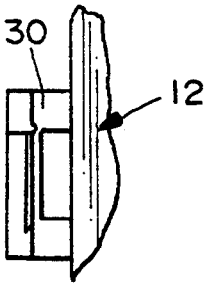
FIG. 6 is a plan view looking down on the mounting boss as viewed in FIG. 3.
Figure 3:
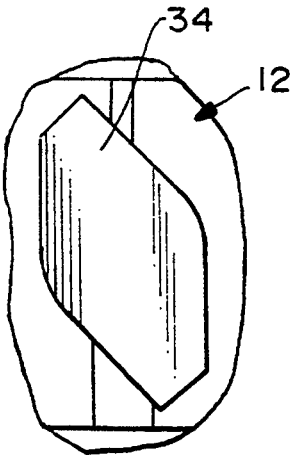
FIG. 3 is a front elevational view of the headed mounting boss of the connector, the connector being fragmented.
Figure 4:
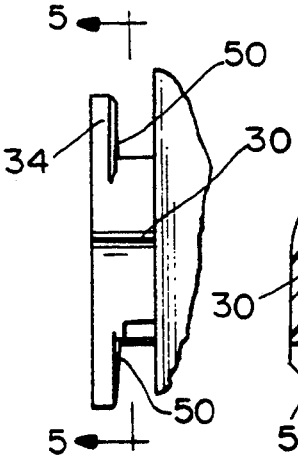
FIG. 4 is a side elevational view of the mounting boss of FIG. 3.
Figure 5:
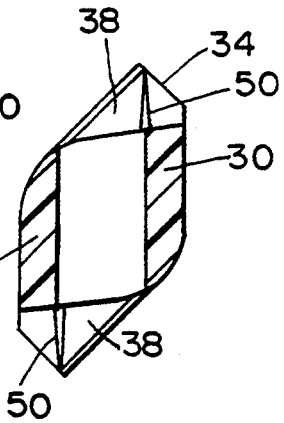
FIG. 5 is a vertical section taken generally along line 5—5 of FIG. 4.

More particularly, and referring to FIGS. 4–6, the wedge means are provided by at least a pair of tapered ribs 50 on the back side of enlarged head portion 34 outside boss 30. The ribs are wider near the boss and become narrower toward the periphery of the enlarged head portion, as can be seen best in FIG. 5. More significantly, the ribs have a maximum thickness near the boss and a minimum thickness near the periphery of the enlarged head portion, as can be seen best in FIG. 4. Therefore, as the connector housing is rotated relative to panel 28, the thinnest outer points of ribs 50 initially will engage the edges of aperture 36 in the panel. Continued rotation causes the ribs to move further against the outside 40 of the panel to draw the housing tighter against the inside 26 of the panel. In fact, with the entire connector housing, including the boss and enlarged head portion 34 being molded of plastic material, ribs 50 can be dimensioned so that they are deformable to ensure a very tight fit between the connector housing and the panel in a direction generally perpendicular to the panel. With detent projections 44 and detent recesses 46 preventing relative rotation between the housing and the panel once the housing is rotated to its tight mounting position, a very secure mounting system is provided by the invention.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A system for mounting an electrical connector to one side of a panel, comprising:

a connector including a housing having a mounting face with a mounting boss projecting therefrom, the mounting boss including an enlarged head portion;

a panel including an aperture shaped for receiving the enlarged head portion therethrough such that the boss is rotatable in the aperture from a first insertion position and a second mounted position of the housing whereat the enlarged head portion overlaps the opposite side of the panel; and wedge means on the underside of the enlarged head portion of the boss for engaging the opposite side of the panel and drawing the housing against the one side of the panel in response to said rotation of the housing from the first position to the second position, said wedge means comprising a tapered rib having a maximum thickness nearer the boss and a minimum thickness nearer the periphery of the enlarged head portion to define a gap between the panel and the underside of the enlarged head portion that is narrower near the boss than near the periphery of the enlarged head portion

2. The system of claim 1 wherein said tapered rib is of deformable plastic material whereby the rib can be deformed when the housing is rotated to the second position.

3. A system for mounting an electrical connector to one side of a panel, comprising:

a connector including a housing having a mounting face with a mounting boss projecting therefrom, the mounting boss including an enlarged head portion;

a panel including an aperture shaped for receiving the enlarged head portion therethrough such that the boss is rotatable in the aperture from a first insertion position and a second mounted position of the housing whereat the enlarged head portion overlaps the opposite side of the panel; and wedge means on the underside of the enlarged head portion of the boss for engaging the opposite side of the panel and drawing the housing against the one side of the panel in response to said rotation of the housing from the first position to the second position, said wedge means being a narrow rib of deformable plastic material which can deform when the housing is rotated to the second position.

* * * * *